US005250753A

United States Patent [19]

Schneider

[11] Patent Number: 5,250,753

[45] Date of Patent: Oct. 5, 1993

[54] WIRE ASSEMBLY FOR ELECTRICALLY CONDUCTIVE CIRCUITS

[75] Inventor: Walter T. Schneider, Portsmouth, R.I.

[73] Assignee: The United States of America as represented by the Secretary of the Navy, Washington, D.C.

[21] Appl. No.: 866,921

[22] Filed: Apr. 10, 1992

[51] Int. Cl.[5] ..... H01B 7/34

[52] U.S. Cl. ..... 174/36; 174/115; 174/117 R; 174/117 F

[58] Field of Search ..... 174/36, 115, 117 R, 174/117 F, 250, 254

[56] References Cited

U.S. PATENT DOCUMENTS 4,487,992 12/1984 Tomita ..... 174/36
4,490,574 12/1984 Tomita et al. ..... 174/36
4,492,815 1/1985 Maros ..... 174/36
4,737,598 4/1988 O'Conner ..... 174/36
4,943,688 7/1990 Van Deusen et al. ..... 174/36 X
4,972,041 11/1990 Crawley et al. ..... 174/36
5,132,489 7/1992 Yamano ..... 174/36

*Primary Examiner*—Morris H. Nimmo
*Attorney, Agent, or Firm*—Michael J. McGowan; Prithvi C. Lall; Michael F. Oglo

[57] ABSTRACT

A wire assembly for electrically conductive circuits, the assembly comprising a circuit conductor wire having a coating of insulative material thereon, a shielding foil wrapped at least partially around the coating and having a leg portion extending outwardly from the coating, a shield conductor wire fixed to the shielding foil, and an insulative outer layer enclosing the shielding foil and the shield conductor wire.

16 Claims, 1 Drawing Sheet

WIRE ASSEMBLY FOR ELECTRICALLY CONDUCTIVE CIRCUITS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention relates to electrically conductive wire assemblies and is directed more particularly to such a wire assembly having utility in the construction of prototype circuits.

2. Description of the Prior Art

In the construction of one-of-a-kind circuits of some permanence, it is common to use a "breadboard", or "wire-wrap" panel. Such a board or panel is provided with a multitude of integrated circuit sockets, or pads, with a pin, typically 0.3 to 0.6 inch long, protruding from each socket connection. The pins are made of a hard metal. A circuit is constructed by wrapping wire tightly around the pins. It is common to use copper or silver plated copper wire of 26 or 30 gauge, covered by an insulative material.

A disadvantage experienced in the use of such wire is its lack of capability to provide shielding which is necessary to minimize coupling effects and provide a low impedance ground path. The presence of coupling interferes with the operating frequency of the circuitry, rendering the circuit less effective.

An alternative wire form used in breadboard constructions comprises a twisted pair of insulated wires. The twisted pair form can be effective in reducing magnetic pickup because the signals induced in successive twists cancel each other, at least to an extent, providing a shielding. However, the shielding is decidedly less than the desired 100%, leaving the wire vulnerable to coupling.

A further alternative embodiment is shielded coaxial wire. Such wires are generally provided with shielding in the form of a round conductor surrounding the usual circuit conductor wire and insulation. The use of the round conductor enlarges the diameter of the wire to a point at which the wire does not readily fit between the wire-wrap pins. Thinner coaxial wires are prone to breakage.

Accordingly, there is a need for a wire assembly suitable for use in the construction of breadboard prototypes, which wire assembly is shielded and of suitable configuration for breadboard use.

SUMMARY OF THE INVENTION

It is, therefore, an object of the invention to provide a wire form, or wire assembly, having a shielding facility integral therewith.

A further object of the invention is to provide such a wire assembly having a physical configuration adapting the wire for use in breadboard or wire-wrap prototypes.

With the above and other objects in view, as will hereinafter appear, a feature of the present invention is the provision of a wire assembly for electrically conductive circuits, the assembly comprising a circuit conductor wire having a coating of insulative material thereon, a shielding foil wrapped at least partially around the coating and having a leg portion extending outwardly from the coating, a shield conductor wire fixed to the shielding foil, and an insulative outer layer enclosing the shielding foil and the shield conductor wire.

The above and other features of the invention, including various novel details of construction and combinations of parts, will now be more particularly described with reference to the accompanying drawings and pointed out in the claims. It will be understood that the particular wire form embodying the invention is shown by way of illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which is shown an illustrative embodiment of the invention, from which its novel features and advantages will be apparent.

DESCRIPTION OF THE PREFERRED EMBODIMENT

Figure 1:
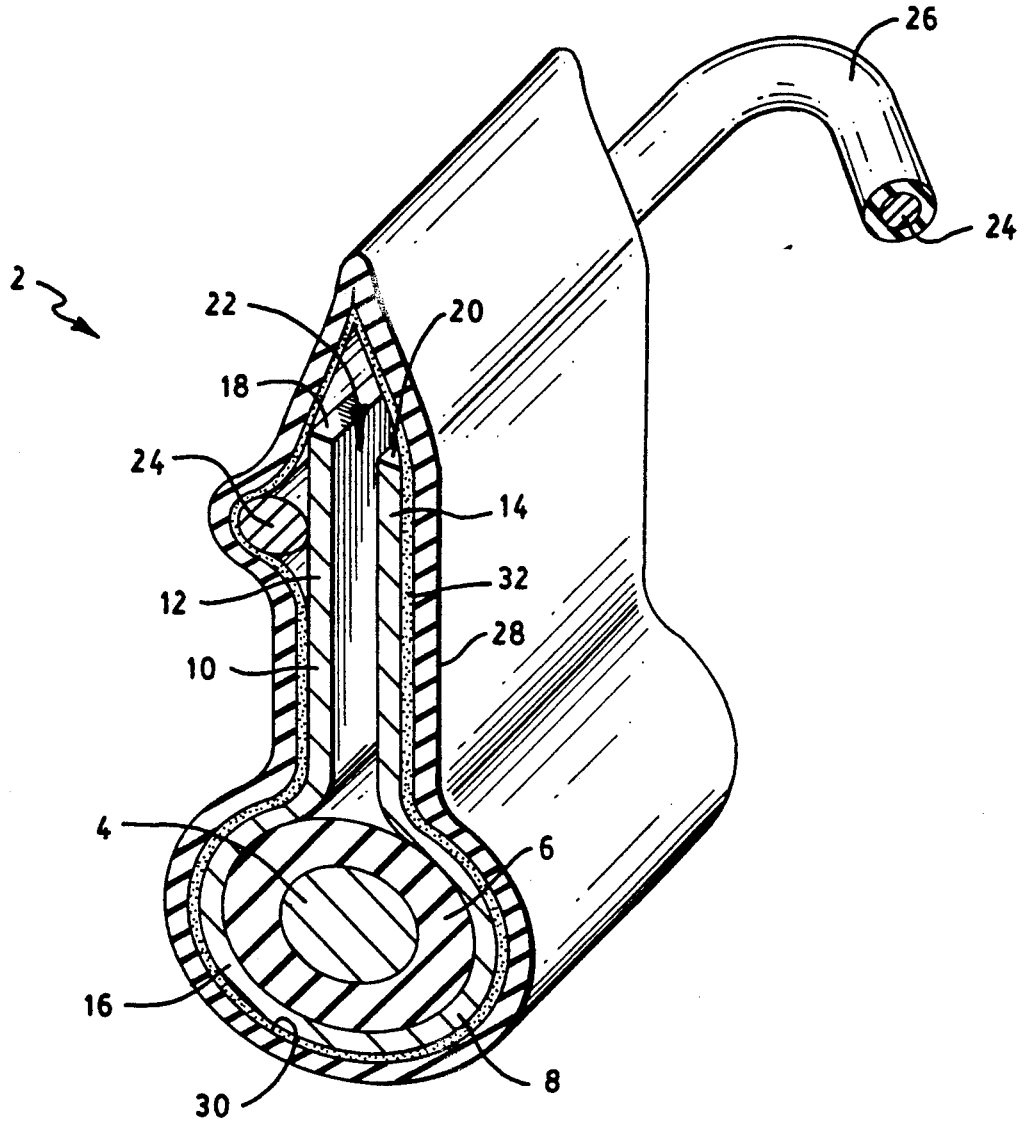
FIG. 1 is a perspective view of a segment of wire, with a cross-section taken widthwise through the wire, illustrative of an embodiment of the invention.

Referring to the drawing, it will be seen that the illustrative wire assembly 2 includes a solid circuit conductor wire 4, typically of copper or silver plated copper, having a coating 6 of insulative material thereon The conductor 4 and coating 6 may be the usual wire form commonly in use in breadboard constructions.

A shielding foil 8 comprises a flat metal strip, preferably of copper, silver plated copper, or aluminum. The shielding foil strip is wrapped around a major portion of the insulative material coating 6 As may be seen in the drawing, the shielding foil 8 comprises a leg portion 10 extending outwardly from the insulative coating 6. The shielding foil leg portion 10 comprises first and second generally flat and parallel leg portions 12, 14, with a U-bend portion 16 therebetween and at least partially encircling the insulative material 6. The shielding foil 8 thus has first and second edges 18, 20 extending substantially parallel to a central axis of the circuit conductor wire 4. The shielding foil edges 18, 20 are disposed proximate each other and spaced from each other, the leg portions 12, 14 having a gap 22 therebetween. It is to be noted that the gap 22 preferably is small.

An uninsulated shield conductor wire 24 is bonded, as by press fit, soldering, or braising, to an outboard surface of the shielding foil leg portion 10. Any portion of the shield conductor wire 24 outside of the wire assembly is covered by an insulative layer 26. At the point at which the wire 24 enters the shielded wire assembly, the wire 24 is uninsulated and bonded to one of the legs 12, 14 of the shielding foil 8.

The assembly, as above described, is covered by an outer insulation sleeve 28. An inner surface 30 of the insulation sleeve 28 may be provided with a layer of adhesive 32 by which the sleeve 28 is bonded to the shielding foil 8 and the shield conductor wire 24. The sleeve 28 insulates a portion of the shield conductor wire 24 from pins (not shown) on the breadboard or wire-wrap panel, as the wire assembly is wound around the pins. The sleeve 28 may be bonded to the assembly in any preferred manner, adhesive bonding being one of several options and found to be quite suitable.

The wire form, or assembly, as above described, has been found to provide several advantages over the various prior art wire forms customarily used in breadboard constructions. The improved shielding provides results in improved control of impedance and reduced coupling between adjacent conductors in the constructed circuit. Further, the physical configuration of the wire form herein, a generally ribbon-like configuration, permits easy insertion between pins. The prior art coaxial wire form and the prior art twisted pair wire form are typically of a diameter of about 0.075 inch, whereas the diameter of the wire form herein described is about 0.010 inch. Still further, the combination of thin, flat and wide shielding foil and the shield conductor wire provide a low inductance ground path, facilitating improved performance.

It is to be understood that the present invention is by no means limited to the particular construction herein disclosed and/or shown in the drawing, but also comprises any modifications or equivalents within the scope of the claims.

Having thus described my invention, what I claim as new and desire to secure by Letters Patent of the United States is:

1. A wire assembly for electrically conductive circuits, the assembly comprising a circuit conductor wire having a coating of insulative material thereon, a shielding foil wrapped at least partially around said coating and having a leg portion extending outwardly from said coating, a shield conductor wire fixed to said shielding foil, and an insulated outer layer enclosing said shielding foil and said shield conductor wire, wherein said shield wire is fixed to an outboard surface of said leg portion of said shielding foil.

2. The wire assembly in accordance with claim 1 wherein said outer layer is bonded to said shielding foil.

3. The wire assembly in accordance with claim 1 wherein said outer layer is bonded to said shielding foil and to said shield wire.

4. The wire assembly in accordance with claim 1 wherein said leg portion of said shielding foil comprises first and second portions of said shielding foil extending outwardly from a U-bend portion of said shielding foil therebetween, said U-bend portion of said shielding foil being wrapped around a major portion of said coating of insulative material.

5. The wire assembly in accordance with claim 4 wherein said shield conductor wire is fixed to one of said shielding foil first and second portions.

6. The wire assembly in accordance with claim 1 wherein said outer layer is adhesively bonded to said shielding foil.

7. The wire assembly in accordance with claim 3 wherein said outer layer is adhesively bonded to said shielding foil and to said shield wire.

8. A wire assembly for electrically conductive circuits, the assembly comprising a circuit conductor wire, an insulative coat on and around said circuit conductor wire, a shielding foil having first and second edges extending substantially parallel to a central axis of said conductor wire and being disposed proximate each other with a U-bend foil portion therebetween, the U-bend portion of said shielding foil wrapping around a major portion of said insulative coat, a shield conductor wire fixed to said shielding foil, and an insulative outer layer enclosing said shielding foil and said shield conductor wire.

9. The wire assembly in accordance with claim 8 wherein said shield conductor wire is fixed to said shielding foil proximate one of said first and second edges.

10. The wire assembly in accordance with claim 9 wherein said outer layer is bonded to said shielding foil and to said shield conductor wire.

11. The wire assembly in accordance with claim 10 wherein said outer layer is adhesively bonded to said shielding foil and to said shield conductor wire.

12. wire assembly in accordance with claim 9 wherein said first and second edges are proximate each other and spaced from each other.

13. The wire assembly in accordance with claim 12 wherein said first and second edges are defined, respectively, by first and second leg portions of said shielding foil extending generally parallel to each other and outwardly from said insulative coat.

14. The wire assembly in accordance with claim 13 wherein said first and second leg portions are removed from each other to define a gap therebetween.

15. The wire assembly in accordance with claim 8 wherein said shielding foil is of a material selected from a group containing copper, silver plate copper, and aluminum.

16. The wire assembly in accordance with claim 8 wherein a major portion of said shield conductor wire is uninsulated.

* * * * *